US009839282B1

(12) United States Patent
Canales

(10) Patent No.: US 9,839,282 B1
(45) Date of Patent: Dec. 12, 2017

(54) COSMETIC BRUSH DEVICE

(71) Applicant: Maria Canales, Pittsburg, CA (US)

(72) Inventor: Maria Canales, Pittsburg, CA (US)

( * ) Notice: Subject to any disclaimer, the term of this patent is extended or adjusted under 35 U.S.C. 154(b) by 0 days.

(21) Appl. No.: 14/273,884

(22) Filed: May 9, 2014

(51) Int. Cl.
*A45D 44/18* (2006.01)
*A46B 9/02* (2006.01)

(52) U.S. Cl.
CPC ..... *A46B 9/021* (2013.01)

(58) Field of Classification Search
CPC ..... A46B 9/021
USPC ..... 132/313, 901, 216, 218, 160, 161, 317, 132/318, 320, 73; 401/24, 129, 268; 15/207.2, 167.3, 159.1, 160, 106, DIG. 5; D4/132–136
See application file for complete search history.

(56) References Cited

U.S. PATENT DOCUMENTS 1,120,476 A * 12/1914 Hansen ..... 15/191.1
1,382,681 A * 6/1921 Segal ..... 15/167.1
3,097,386 A * 7/1963 Marani ..... 15/167.1
3,349,781 A * 10/1967 Poole et al. ..... 132/208
4,014,064 A * 3/1977 Okazaki ..... 15/207.2
4,091,490 A * 5/1978 Allen ..... 15/207.2
4,454,622 A * 6/1984 Poppendieck ..... 15/167.3
4,730,361 A * 3/1988 Koffler ..... 15/160
4,998,315 A 3/1991 Pessis
5,345,644 A 9/1994 Gueret
5,357,987 A 10/1994 Schrepf
5,450,865 A 9/1995 Park
5,507,063 A * 4/1996 Hirsch ..... 15/160
5,570,487 A * 11/1996 Schneider ..... 15/167.1
D380,615 S * 7/1997 Roberts ..... D4/135
5,709,230 A 1/1998 Miraglia
6,026,824 A * 2/2000 Gueret ..... 132/218
6,039,051 A * 3/2000 Dorf ..... 132/313
6,073,634 A * 6/2000 Gueret ..... 132/218
6,190,075 B1 * 2/2001 Lewis ..... 401/129
6,224,287 B1 * 5/2001 Gieux ..... 401/282
6,779,532 B2 8/2004 Dorf
7,159,950 B2 * 1/2007 Young-Chul ..... 300/21
7,832,956 B2 * 11/2010 Ross ..... 401/269
7,895,698 B2 3/2011 Mink
7,922,410 B2 * 4/2011 Gueret ..... 401/129
7,930,792 B2 * 4/2011 Russell ..... 15/167.2
7,950,402 B1 5/2011 Cole
8,104,132 B2 1/2012 Mink
8,156,599 B2 * 4/2012 Waguespack et al. .... 15/104.94
8,256,437 B2 9/2012 Gueret
9,055,807 B2 * 6/2015 Dale ..... A46B 9/026
2004/0003478 A1 * 1/2004 Mink ..... 15/160
2007/0151061 A1 * 7/2007 Mink et al. ..... 15/160
(Continued)

FOREIGN PATENT DOCUMENTS

JP 201029567 2/2010

*Primary Examiner* — Rachel Steitz
(74) *Attorney, Agent, or Firm* — Theodore J. Bielen, Jr.

(57) ABSTRACT

A cosmetic brush device utilizing a plurality of bristles mounted to a base holder. A first portion of the bristles are located adjacent the base holder and include a part having a narrow transverse dimension, a second part possessing a relatively wide transverse dimension, and an intermediate part positioned between the first and second parts possessing a transverse dimension of a value between the first and second parts. The bristles also extend outwardly to a second portion having a crest of curved configuration.

7 Claims, 2 Drawing Sheets

(56) References Cited

U.S. PATENT DOCUMENTS

| | | | | |
|---|---|---|---|---|
| 2010/0236004 | A1* | 9/2010 | Xu | 15/160 |
| 2010/0319720 | A1* | 12/2010 | Thorne et al. | 132/218 |
| 2011/0185528 | A1* | 8/2011 | Befve et al. | 15/207.2 |
| 2012/0298130 | A1* | 11/2012 | Telwar et al. | 132/317 |
| 2013/0199556 | A1* | 8/2013 | Lim | 132/148 |
| 2014/0196237 | A1* | 7/2014 | Dale | 15/190 |

* cited by examiner

COSMETIC BRUSH DEVICE

BACKGROUND OF THE INVENTION

The present invention relates to a novel and useful cosmetic brush device particularly useful to apply eyeliner about the eye of a human.

Cosmetics have been used since ancient times for esthetic purposes and to protect facial skin from the harmful rays of the sun. For example, eyeliner markings are believed to have been used at least as early as ancient Egypt and Mesopotamia, as is evidenced by art from this period. In the twentieth century, cosmetics, including eyeliners, have been very commonly used by women in the western world.

Eyeliner impressions can be softly applied or clearly defined. Also, eyeliners may take the form of a liquid, a powder-based material, a wax-based material, a cream or a gel. In general, the application of such eyeliner materials is effected with pencils, pens or brushes.

To properly apply eyeliner, a fair degree of skill is required. Prior art brushes for creating eyeliner applications have resulted in inconsistent appearances, requiring reapplications, which is time consuming and frustrating.

Many brushes and applicators have been devised to apply cosmetics to the skin of a user. For example, U.S. Pat. Nos. 5,345,644, 5,709,230, and 8,256,437 show cosmetic application brushes in which bristles are extended along a central core and extended therefrom in various configurations to apply cosmetics to the eyelashes or hair.

U.S. Pat. No. 5,357,987 and Japanese patent application 201029567 describe brushes for applying cosmetics that utilize a central shaft and bristles that extend therefrom in a discontinuous fashion.

U.S. Pat. No. 7,895,698 shows an applicator brush having two sets of bristles of varying lengths inside by side configuration and held by a ferrule.

U.S. Pat. No. 8,104,132 teaches an applicator brush which provides for a protruding tuft extending from companion bristles of shorter length than the tuft.

U.S. Pat. Nos. 6,779,532 and 7,950,402 illustrate cosmetic brushes which have curved end portions.

U.S. Pat. Nos. 4,998,315 and 5,450,865 describe brushes that include end portions that have sliced or scalped bristles.

A cosmetic brush which is particularly suitable for the application of eyeliner would be a notable advance in the field of cosmetics.

SUMMARY OF THE INVENTION

In accordance with the present invention a novel and useful cosmetic brush device is herein provided.

The cosmetic brush device of the present application includes a plurality of bristles mounted to a base holder which may be in the form of a collar or ferrule. The plurality of bristles include a first portion located adjacent the base holder. The first portion has a first part possessing a relatively narrow transverse dimension. Likewise, the first portion of the plurality of bristles also include a second part possessing a relatively wide transverse dimension. An intermediate part, positioned between the first part and second parts of the first portion of the plurality of bristles, possesses a transverse dimension having a value between the transverse dimension of the first and second parts. In other words, the first portion of the plurality of bristles located adjacent the base holder graduate between a narrow transverse dimension and a relatively wide transverse dimension.

A second portion of the plurality of bristles is located outwardly from the base holder at a greater distance than the first portion of the plurality of bristles. The second portion of the plurality of bristles terminate in free tips of the plurality of bristles to form a crest or peak. The crest may take the form of a curved crest that may be a symmetrical convex curved crest. The transverse dimension of the crest is less than the transverse dimension of first part of the first portion of the plurality of bristles.

Further, the cosmetic brush device of the present invention may include a lateral support to the first, second, and intermediate parts of the first portion of the plurality of bristles. The lateral support lies between the base holder and the first, second and intermediate parts of the first portion of the plurality of bristles. Such lateral support may graduate in width between the first and second parts of the first portion of the plurality of bristles.

It may be apparent that a novel and useful cosmetic brush device has been hereinabove provided.

It is therefore an object of the present invention to provide a cosmetic brush device that is particularly contoured to allow the user to apply cosmetic compounds to the body of the user.

Another object of the present invention is to provide a cosmetic brush device that is particularly useful for the application of eyeliner material.

A further object of the present invention is to provide a cosmetic brush device that may be employed with eyeliner material in the form of a liquid, powder, wax, or gel.

Another object of the present invention is to provide a cosmetic brush device that allows the user to accurately produce an eyeliner pattern above the upper lashes of the eye.

A further object of the present invention is to provide a cosmetic brush device which may be used to apply eyeliner material to create an esthetic appearance that draws attention to eye of the user.

Yet another object of the present invention is to provide a cosmetic brush device for the application of eyeliner material which is easily used by persons of little or moderate skill in the cosmetology arts.

The invention possesses other objects and advantages especially as concerns particular characteristics and features thereof which will become apparent as the specification continues.

BRIEF DESCRIPTION OF THE SEVERAL VIEWS THE DRAWING

Figure 1:
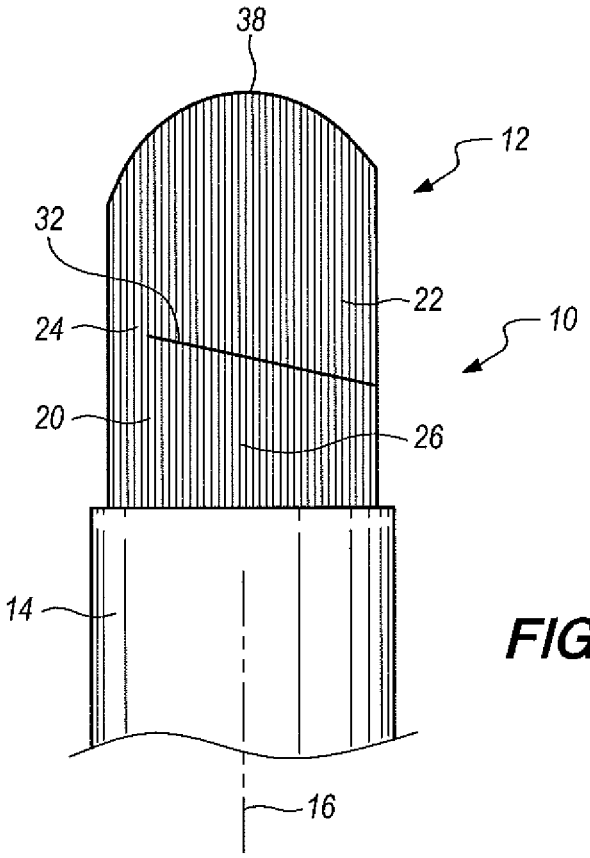
FIG. 1 is a front elevational view of the cosmetic brush device of the present invention.

is For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present cosmetic brush device may evolve from the following detailed description of the preferred embodiments thereof which will be referenced of the prior described drawings.

A cosmetic brush device of the present application is shown as a whole in the drawing by reference character 10. Brush device 1, FIGS. 1 and 2, includes as one of its elements, a plurality of bristles 12 that extend from and are held by a base holder or ferrule 14. Ferrule 14 and plurality of bristles 12 generally lie and are oriented along axis 16. It should be noted that ferrule 14 connects to a handle 18 which also generally lies along axis 16 and is partially shown in FIG. 5 hereinafter.

Figure 2:
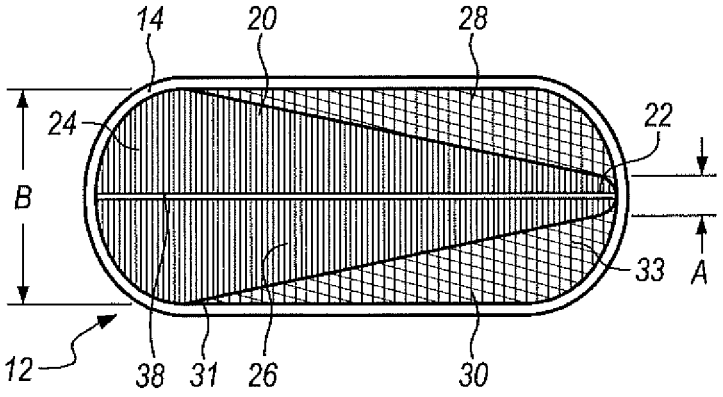
FIG. 2 is a top plan view of the cosmetic brush device of the present invention.
Figure 3:
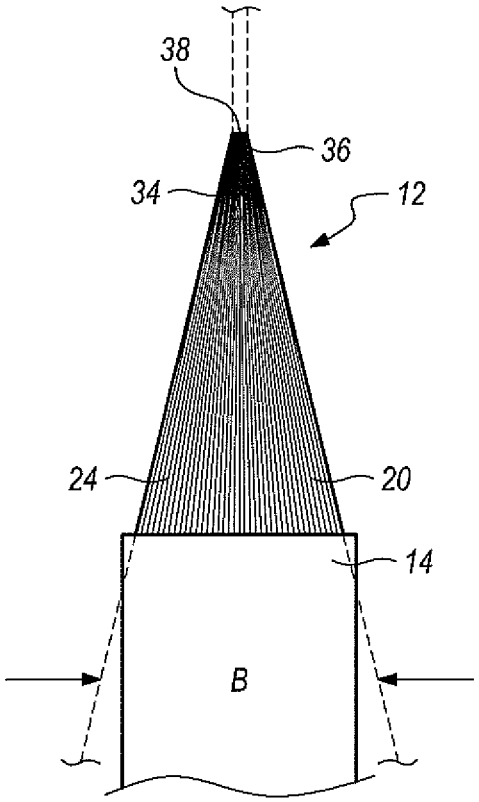
FIG. 3 is a left side elevational view of the cosmetic brush device of the present invention shown in FIG. 1.

With further reference to FIGS. 1 and 2, it may be observed that plurality of bristles 12 includes a first portion 20 located adjacent base holder or ferrule 14. First portion is formed with a first part 22 that has a relatively narrow transverse dimension "A", FIG. 4. Also, plurality of bristles 12 forms a second part 24 possessing relatively wide transverse dimension "B", FIGS. 2 and 3. Intermediate part 26 lies between first narrow part 22 and second wide part 24 and possesses a transverse dimension having a value between the relatively narrow transverse dimension of first part 22 and the relatively wide transverse dimension of second part 24.

Figure 4:
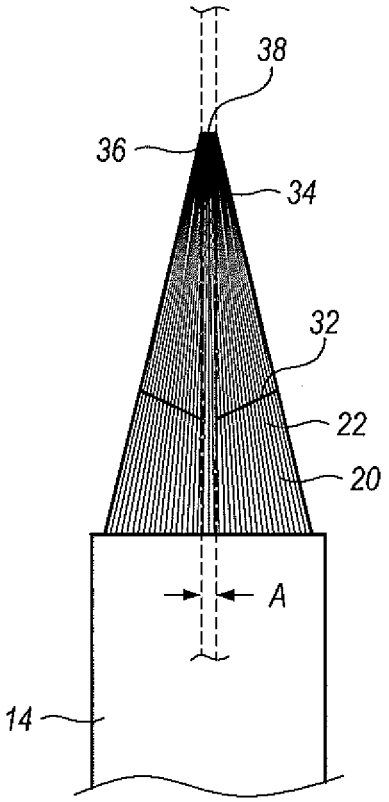
FIG. 4 is a right side elevational view of the cosmetic brush device of FIG. 1.

First part 22, second part 24, and intermediate part 26 are created by the removal of bristles from segments 28 and 30 of plurality of bristles 12, FIG. 2. Of course, brush device 10 may be formed initially with shortened bristles in segments 28 and 30 rather than by removing bristle material from plurality of bristles 12. In any case, segments 28 and 30 extend between first narrow part 22 and second wide part 24 of plurality of bristles 12. The shortened bristles found in segments 28 and 30 decrease in width from first narrow part 22 toward second wide part 24 of first portion 20 of plurality of bristles 12. In addition, the height if the shortened bristles in segments 28 and 30 increase from narrow first part 22 to wide second part 24 of plurality if bristles 12, as is evidence by upwardly slanted schematic line 21 depicted in FIG. 1. Consequently, the bristles found in second relatively wide part 24 of plurality of bristles 12 are provided with a lateral support 31 of greater bulk that lateral support 33 adjacent first narrow part of plurality of bristles 12. FIGS. 1 and 4. Lateral support 33 adjacent narrow first part 22 of plurality of bristles 12, possesses lesser bulk than lateral support 31 due to the larger number of shortened bristles adjacent narrow first part 22.

A second portion 34 of plurality of bristles 12 lies at a distance further outwardly from base holder 14 than first portion 20 of plurality of bristles 12. Second portion 34 of plurality of bristle 12 terminates in a multiplicity of free tips 36 forming a peak or crest 38. Crest 38 is curved and is generally symmetrically convex in configuration relative to base holder or ferrule 14.

Figure 5:
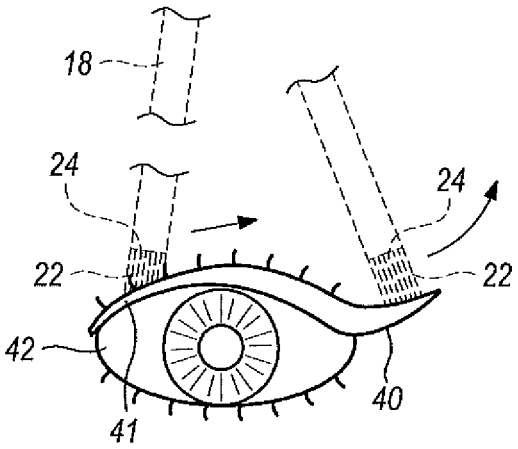
FIG. 5 is a schematic view of an eyeliner pattern applied to an eye using the cosmetic brush device of the present invention.
Figure 6:
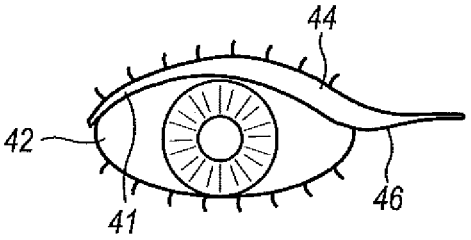
FIG. 6 (PRIOR ART)
FIG. 6 is an eyeliner pattern applied with a cosmetic brush of the prior art.

In operation, the user grasps handle 18 of brush device 10 and applies marking material such as eyeliner liquid, to the plurality of bristles 12. Relatively wide part 24 of plurality of bristles 12 begins the marking of pattern 40, commonly known as a "cat eye", on the eyelid 41 of eye 42. The brush device may be tilted to the right at the beginning of the marking stroke as shown in FIG. 5, or may be perpendicular to the eye 42 (not shown). Plurality of bristles of brush device 10 are then drawn over eyelid 41 and device 10 is tilted to the left (FIG. 5) toward the end of the stroke, to press relatively narrow part 22 of plurality of bristles 12 against eyelid 41. The result is a smooth double crescent, sharply define "cat eye" marking, as depicted in FIG. 5. It should be seen that prior art devices produce a marking 44, FIG. 6, which is not as smoothly curved as marking 40, in FIG. 5. Noteably, sharp corners, such as corner 46, of FIG. 6 , are formed, which are deemed to be undesirable.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A cosmetic brush device having a plurality of bristles mounted to a base holder with the plurality of bristles extending therefrom, comprising:

a first portion of the plurality of bristles located adjacent the base holder said first portion of the plurality of bristles including a first part possessing a first transverse dimension, a second part possessing a second transverse dimension, said first transverse dimension being less than second transverse dimension, defining said first part as a first relatively narrow part and said second part as a second relatively wide part, and an intermediate part possessing a transverse dimension of a value between said transverse dimension of said first relatively narrow part and said second relatively wide part; and a second portion of the plurality of bristles located outwardly from the base holder at a distance greater than said location of said first portion of bristles located adjacent the base holder, said second portion of the plurality of bristles terminating in a plurality of free tips of the plurality of bristles and forming a curved crest extending between said first relatively narrow part and said second relatively wide part of said first portion of the plurality of bristles and reaching a peak between said first relatively narrow part and said second relatively wide part, said peak of said curved crest positioned further outwardly from the base holder than said first relatively narrow part and said second relatively wide part of said first portion of the plurality of bristles; and a lateral support adjacent to said second part of said plurality of bristles, said lateral support comprising a plurality of shortened bristles mounted to the base holder, said shortened bristles being shorter than said plurality of bristles forming said curved crest.

2. The device of claim 1 in which said curved crest comprises a symmetrical convex curved crest.

3. The device of claim 1 in which said crest has a transverse dimension of less than said first part of said first portion.

4. The device of claim 1 in which the transverse dimension of said first portion of the plurality of bristles tapers between said first and second parts thereof.

5. The device of claim 4 in which said curved crest comprises a symmetrical convex curved crest.

6. The device of claim 4 in which said curved crest has a transverse dimension less than said first part of said first portion.

7. The device of claim 1 in which said lateral support adjacent said first part of said plurality of bristles possesses less bulk than said lateral support adjacent said second part of said plurality of bristles.

* * * * *